US005799675A

United States Patent [19]

Gunderman et al.

[11] Patent Number: 5,799,675

[45] Date of Patent: Sep. 1, 1998

[54] SCREEN PRINTED PRODUCT SAMPLER IN HERMETICALLY SEALED PACKAGE

[75] Inventors: Anthony J. Gunderman, Phoenix; Cathleen M. Fleming, Forest Hill, both of Md.

[73] Assignee: Color Prelude, Inc., Baltimore, Md.

[21] Appl. No.: 810,370

[22] Filed: Mar. 3, 1997

[51] Int. Cl.[6] ..... A45D 44/00

[52] U.S. Cl. ..... 132/333; 132/317

[58] Field of Search ..... 132/333, 319, 132/320, 317; 156/277, 280; 206/823, 368; 424/64, 401; 427/256, 265

[56] References Cited

U.S. PATENT DOCUMENTS

| | | | |
|---|---|---|---|
| 1,743,512 | 1/1930 | Aisen | 132/312 |
| 1,744,532 | 1/1930 | Ean | 132/312 |
| 1,836,833 | 12/1931 | Ames | 424/401 |
| 1,885,076 | 10/1932 | Bustamante | 132/320 |
| 2,061,139 | 11/1936 | Cohen | 206/489 |
| 2,088,076 | 7/1937 | Winslow | 434/100 |
| 2,133,914 | 10/1938 | Burke | 156/280 |
| 2,175,133 | 10/1939 | Singleton | 132/317 |
| 2,185,386 | 1/1940 | Valentine | 206/823 |
| 2,214,510 | 9/1940 | Robinson | 132/314 |
| 2,234,657 | 3/1941 | Smaldone | 132/285 |
| 2,378,935 | 6/1945 | Kraft | 132/73 |
| 2,561,400 | 7/1951 | Morrell | 132/314 |

(List continued on next page.)

FOREIGN PATENT DOCUMENTS

| | | |
|---|---|---|
| 0197184 | 7/1985 | European Pat. Off. . |
| 0197206 | 12/1985 | European Pat. Off. . |
| 0263327 | 9/1987 | European Pat. Off. . |
| 0252001 | 1/1988 | European Pat. Off. . |
| 2589271 | 10/1986 | France . |
| 2601865 | 1/1988 | France . |
| 13537 | 8/1938 | Japan . |
| 53-116906 | 10/1978 | Japan . |
| 56-165661 | 5/1980 | Japan . |
| 57-103862 | 12/1980 | Japan . |
| 57-184967 | 5/1981 | Japan . |

(List continued on next page.)

OTHER PUBLICATIONS

"Practical Technique for Screen Printing".

"Photomechanical Process Silk Screening".

"New Screen Printing Technology Complete Collection", vol. 4, Some Applied Theories of Screen Printing, Seri Graph Co. (Feb. 25, 1986).

Kirk–Othmer, Encyclopedia of Chemical Technology, vol. 6, 2nd Ed., Sep. 1965, pp. 363–366.

E. Noteboom, "Screen Printing: Where Did It All Begin?", Screenprinting (1992), pp. 52–56, 103, 122.

A Series of Well–Known and Widely Used Techniques (Cosmetic Items and Containers), Japanese Patent Office Gazette.

*Primary Examiner*—Gene Mancene
*Assistant Examiner*—Pedro Philogene
*Attorney, Agent, or Firm*—Ostrolenk, Faber, Gerb & Soffen, LLP

[57] ABSTRACT

A consumer product sampler including a base (e.g. a barrier laminate constructed of multiple layers of polymers and/or foil and/or paper) onto which a unit dose of product (e.g. a volatile make-up substance) is screen printed. A cover formed of either a barrier laminate or a clear plastic sheet is sealed to the base at its periphery and overlays the product. If the cover is a barrier laminate, the outer surface can be provided with printed matter identifying the cosmetic or other substance contained in the sampler. Depending upon the product to be sampled, the cover can either be heat sealed to the base or sealed to the base with a perimeter adhesive. If the product to be sampled is a liquid or semi-liquid substance (e.g. water or solvent based), the base is preferably formed of a thermoformable plastic or a paperboard laminated with a barrier laminate and is provided with one or more debossed/embossed wells or cut-outs into which the product to be sampled is screen printed. The product sampler of the present invention is particularly suited for sampling a volatile silicone based substances such as lipstick, liquid make-up or blush.

36 Claims, 4 Drawing Sheets

U.S. PATENT DOCUMENTS

| | | | |
|---|---|---|---|
| 2,735,435 | 2/1956 | Feinstein | 132/320 |
| 2,775,249 | 12/1956 | Morrell | 132/318 |
| 2,998,812 | 9/1961 | Hurdel | 132/218 |
| 3,157,912 | 11/1964 | Lisczawka | 425/2 |
| 3,568,684 | 3/1971 | Reece | 132/333 |
| 3,779,848 | 12/1973 | Maierson | 156/178 |
| 3,788,917 | 1/1974 | Linda | 156/82 |
| 3,811,987 | 5/1974 | Wilkinson et al. | 156/497 |
| 3,860,016 | 1/1975 | Mackiernan | 132/317 |
| 3,888,689 | 6/1975 | Maekawa et al. | 106/24 |
| 4,224,092 | 9/1980 | Thompson | 156/82 |
| 4,372,098 | 2/1983 | Mason | 53/412 |
| 4,487,801 | 12/1984 | Turnbull et al. | 428/313.5 |
| 4,493,869 | 1/1985 | Sweeny et al. | 428/201 |
| 4,611,611 | 9/1986 | Beal, Jr. | 132/320 |
| 4,661,388 | 4/1987 | Charbonneau | 428/43 |
| 4,735,827 | 4/1988 | Frank et al. | 427/264 |
| 4,747,782 | 5/1988 | Campbell, Jr. | 434/377 |
| 4,751,934 | 6/1988 | Moir et al. | 132/79 D |
| 4,752,496 | 6/1988 | Fellows et al. | 427/485 |
| 4,755,433 | 7/1988 | Patel et al. | 428/422 |
| 4,774,133 | 9/1988 | Doree et al. | 428/321.5 |
| 4,805,773 | 2/1989 | Sabongi | 206/489 |
| 4,824,143 | 4/1989 | Grainger | 132/317 |
| 4,848,378 | 7/1989 | Moir et al. | 132/319 |
| 4,876,136 | 10/1989 | Chang et al. | 132/320 |
| 4,884,680 | 12/1989 | Israel et al. | 206/44.11 |
| 4,884,719 | 12/1989 | Levine et al. | 221/25 |
| 4,889,755 | 12/1989 | Charbonneau | 428/42 |
| 4,890,872 | 1/1990 | Parrotta et al. | 132/317 |
| 4,925,667 | 5/1990 | Fellows et al. | 424/64 |
| 4,940,584 | 7/1990 | Tararuj et al. | 424/401 |
| 4,952,400 | 8/1990 | Tararuj et al. | 424/401 |
| 4,988,557 | 1/1991 | Charbonneau | 428/204 |
| 4,995,408 | 2/1991 | Wallschlaeger | 132/320 |
| 4,996,044 | 2/1991 | Mercado et al. | 424/64 |
| 5,000,202 | 3/1991 | Stepan | 132/320 |
| 5,031,647 | 7/1991 | Seidler | 132/320 |
| 5,037,139 | 8/1991 | Schoenleber et al. | 206/823 |
| 5,072,831 | 12/1991 | Parrotta et al. | 132/333 |
| 5,105,941 | 4/1992 | Dolan et al. | 206/232 |
| 5,160,022 | 11/1992 | Mennella | 206/232 |
| 5,161,688 | 11/1992 | Muchin | 132/320 |
| 5,192,386 | 3/1993 | Moir et al. | 156/268 |
| 5,301,697 | 4/1994 | Gueret | 132/298 |
| 5,348,031 | 9/1994 | Cloud | 132/317 |
| 5,391,420 | 2/1995 | Bootman et al. | 428/195 |
| 5,518,790 | 5/1996 | Huber et al. | 428/35.2 |
| 5,533,622 | 7/1996 | Stockley, III et al. | 206/484 |
| 5,535,885 | 7/1996 | Daniel et al. | 206/484 |
| 5,562,112 | 10/1996 | Gunderman | 132/333 |
| 5,566,693 | 10/1996 | Gunderman | 132/333 |
| 5,568,866 | 10/1996 | Grosskopf et al. | 206/466 |
| 5,622,263 | 4/1997 | Greenland | 206/581 |
| 5,645,161 | 7/1997 | Whitaker et al. | 206/0.5 |
| 5,647,941 | 7/1997 | Gunderman | 156/277 |
| 5,690,130 | 11/1997 | Gunderman | 132/319 |

FOREIGN PATENT DOCUMENTS

| | | |
|---|---|---|
| 56-108703 | 8/1981 | Japan . |
| 57-37560 | 3/1982 | Japan . |
| 58-162677 | 9/1983 | Japan . |
| 58-163420 | 9/1983 | Japan . |
| 59-22473 | 2/1984 | Japan . |
| 59-82414 | 6/1984 | Japan . |
| 60-67408 | 4/1985 | Japan . |
| 60-129206 | 8/1985 | Japan . |
| 60-178356 | 9/1985 | Japan . |
| 60-149314 | 10/1985 | Japan . |
| 61-56602 | 3/1986 | Japan . |
| 1329309 | 9/1973 | United Kingdom . |
| WO 8807825 | 10/1988 | WIPO . |

FIG. 3A
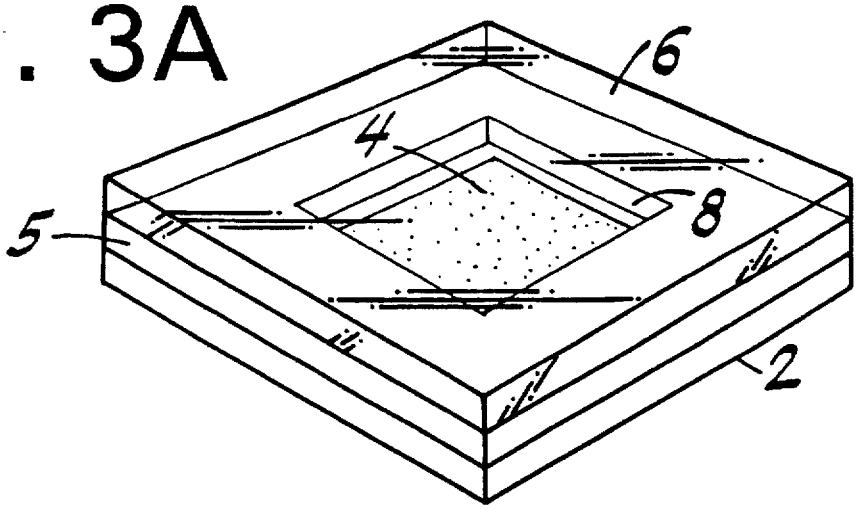
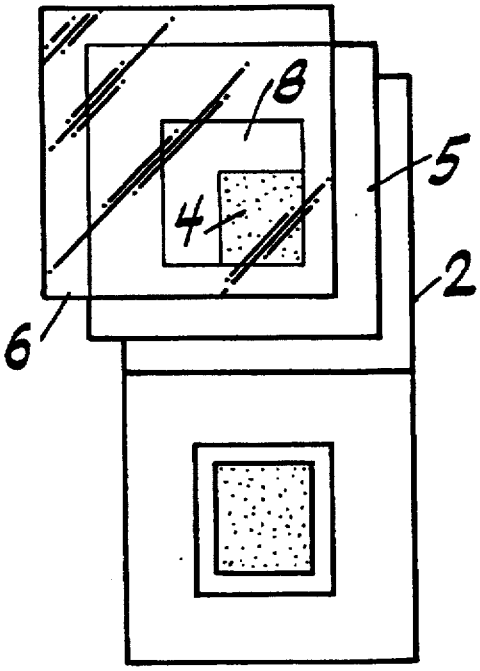
FIG. 3B
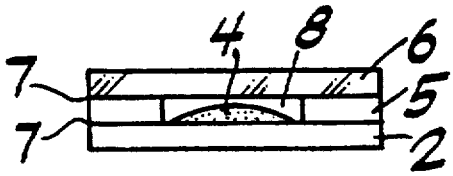
FIG. 4

SCREEN PRINTED PRODUCT SAMPLER IN HERMETICALLY SEALED PACKAGE

BACKGROUND OF THE INVENTION

1. Field of the Invention

The present invention relates to product samplers and, more specifically, to a screen printed product sampler provided in a hermetically sealed package which is particularly suitable for sampling a volatile silicone, such as lipstick, liquid make-up and blush.

2. Description of the Related Art

Cosmetics have typically been available for sampling in department stores in the very containers in which the product is sold, or in smaller versions of the same container. With this method of marketing, a cosmetic can become quite expensive and can create an uneasiness in the consumer since others "have been in the same pot."

Moreover, until recently, there has been no inexpensive and convenient method of marketing cosmetics or other similar products by hand-outs or by mail, e.g., as inserts which accompany department store bills, other than cosmetic "strips", which consist merely of make-up samples deposited on a substrate covered by a paper mask. Such "strips" do not allow for the presentation of the cosmetic sample in a design pattern, nor do they allow for the simultaneous presentation of a number of colors in a single design.

One particularly advantageous type of cosmetic sampler that has recently come into use is a screen printed version, such as disclosed in U.S. Pat. No. 4,751,934, the disclosure of which is herein incorporated by reference. Screen printed cosmetic samplers are unique from other types of cosmetic samplers in that the cosmetic is applied through a patterned mesh and forms a well-defined pattern on the substrate. Thus, screen printed cosmetic samplers advantageously permit the presentation of cosmetic in a specially suited and/or aesthetically pleasing pattern. For example, a screen printed sample of lipstick can be provided on a flat base in the pattern which resembles the shape of a stick of lipstick, or a make-up sampler with various type of make-up can be provided in a colorful package emulating a woman's compact.

Waxed-based cosmetics such as lipsticks and liquid, semi-liquid or solvent based substances such as creams and lotions, present a particular problem for unit dose sampling since they cannot simply be deposited on a flat substrate, due to problems with offset and leakage. Additionally, cosmetics which are based upon a volatile silicone, such as certain types of lipstick, liquid make-up and blush, require specially constructed, hermetically sealed containers to prevent dry out and solvent loss. Such containers, typically in the shape of wands or bottles, are extremely costly and not economically feasible for mass production and distribution.

Accordingly, a need exists for a screen printed product sampler provided in a hermetically sealed container which is inexpensive and readily adaptable to mass packaging and distribution.

SUMMARY OF THE INVENTION

Accordingly, one object of the present invention is to provide an inexpensive sanitary hermetically sealed disposable package which allows the consumer to sample one or more unit doses of a product, such as a lipstick, cream, or other cosmetic, in a medium which can be economically mass produced and distributed as a handout or placed in magazines or mailers.

A second object of the present invention is to provide a unit dose package for sealing volatile silicone based product samples, or other substances in which dry-out and/or solvent loss is a concern.

Briefly, the present invention is a consumer product sampler formed of a base (e.g. a barrier laminate constructed of multiple layers of polymers and/or foil and/or paper) onto which a unit dose of a consumer product (e.g. a volatile make-up substance) is screen printed. A cover is sealed to the base at its periphery and overlays the product. The cover can be formed of either a barrier laminate or clear plastic sheet. If the cover is a barrier laminate, the outer surface can be provided with printed matter identifying the product or other substance contained in the sampler. Depending upon the product to be sampled, the cover can either be heat sealed to the base or sealed to the base with a perimeter adhesive.

If the product to be sampled is a liquid or semi-liquid substance (e.g. water or solvent based), the base is preferably formed of a thermoformable plastic or a paperboard laminated with a barrier laminate, and is provided with one or more debossed/embossed or cut-out wells. The product to be sampled is screen printed directly into the embossed/debossed or cut-out well. If the sampler is provided with multiple wells, the wells are preferably provided in a side-by-side configuration, each of the wells containing a unit dose sample of the screen printed product. As in the first embodiment, a cover is sealed to the base and, in this case, overlays the well or wells containing the screen printed product. The cover can be formed of either a barrier laminate (with or without graphics) or clear plastic sheet.

The screen printed sampler and method of the present invention allows a relatively large amount of a consumer product to be laid down in any desired pattern (whether on a flat base or in a well), and the hermetic seal of the sampler advantageously prevents dry-out or solvent loss from the product. The sampler and method of the present invention is particularly advantageous for sampling water based and solvent based products, such as cosmetics, personal products, pharmaceuticals and foods.

Other features and advantages of the present invention will become apparent from the following description of the invention which refers to the accompanying drawings.

BRIEF DESCRIPTION OF THE DRAWINGS

FIGS. 3A and 3B show a perspective and top view of the product sampler of the present invention provided on a base with a cut-out well for containing the product sample.

FIG. 4 shows a side view of the product sampler of FIGS. 3A and 3B.

DETAILED DESCRIPTION OF THE PREFERRED EMBODIMENT

Figure 1:
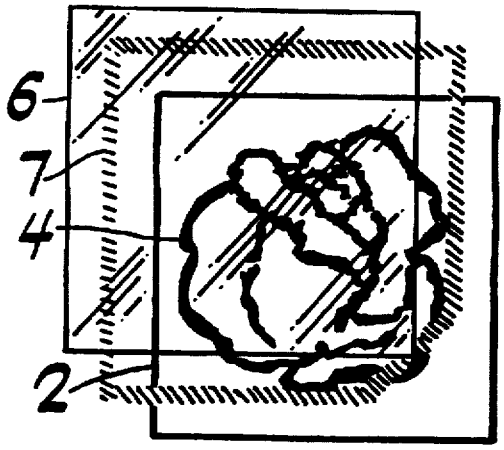
FIG. 1 shows a top view of the product sampler of the present invention provided on a flat base.
Figure 2:
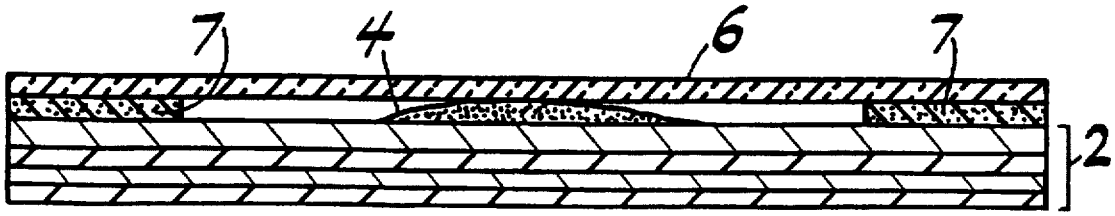
FIG. 2 shows a side view of the product sampler of FIG. 1.

Referring first to FIGS. 1 and 2, the consumer product sampler of the present invention comprises a base 2 onto which a product sample 4 (e.g., volatile make-up) is screen printed in any desired pattern, preferably using the manufacturing method described in U.S. Pat. No. 4,751,934, the disclosure of which is herein incorporated by reference. In the embodiment of the invention shown in FIGS. 1 and 2, base 2 is formed of a flat barrier laminate constructed of multiple layers of polymers and/or foil and/or paper, e.g. a laminate provided on a 12 pt. SBS paperboard stock.

A cover 6 formed of a barrier laminate or a clear plastic film (e.g. 3 mil. polyester) is provided atop the sample 4 and is hermetically sealed to the upper surface of base 2 around the consumer product (e.g. cosmetic) to prevent dry-out and solvent loss of the product. Depending upon the properties of the product sample, cover 6 may either be heat sealed to the base 2 or sealed to the base by a perimeter adhesive 7.

Referring now to FIGS. 3A–8, if the product to be sampled is a liquid or semi-liquid substance (e.g. a water or solvent based cosmetic), base 2 is provided in a layered embodiment with a cut-out forming a well 8 (FIGS. 3A, 3B and 4), or the base can be formed with an embossed or debossed well 10 (FIGS. 5–6) or provided with multiple wells 12 in a side-by-side configuration (FIGS. 7–8) for containing and preventing leakage of the consumer product or products to be sampled.

In the embodiment of the invention shown in FIGS. 3A, 3B and 4, the layered embodiment with a cut-out forming a well 8 is preferably formed in the manner described in U.S. Pat. No. 5,562,112, the disclosure of which is herein incorporated by reference. More specifically, in the embodiment of FIGS. 3A, 3B and 4, the product sample 4 and base 2 lie beneath a cover 6 by means of a spacing element 5. The spacing element 5 may be a coated board, paper, or film provided with a cut-out portion. The cut-out is adapted to surround sample 4 creating a well 8 in which the sample 4 sits. Cover 6, which is shown in FIGS. 3–4 as a polyester film overlay, is attached to the spacing element 5 by means of an adhesive 7, and the spacing element 5 is similarly attached to the base 2 by means of an adhesive 7. The resulting well 8 forms a container for sample 4 and prevents offset of the sample 4 onto the cover 6.

Figure 5:
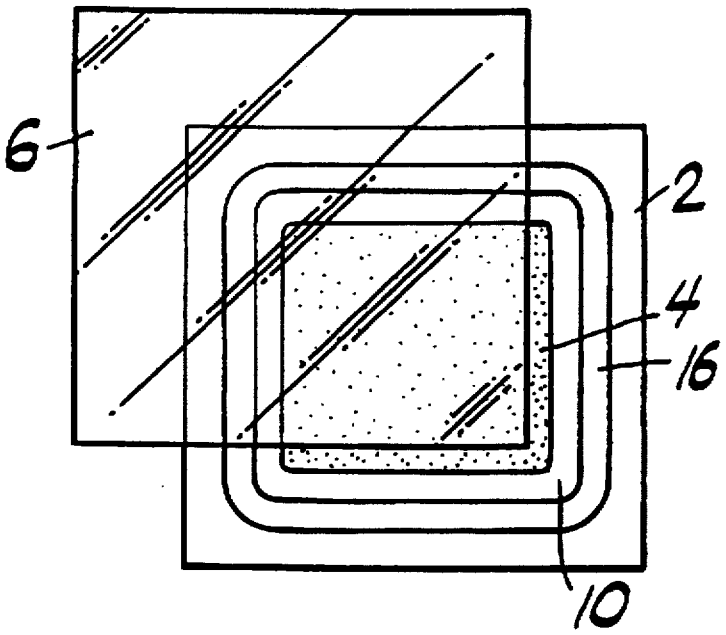
FIG. 5 shows a top view of the product sampler of the present invention provided on a base with an embossed or debossed well.
Figure 6:
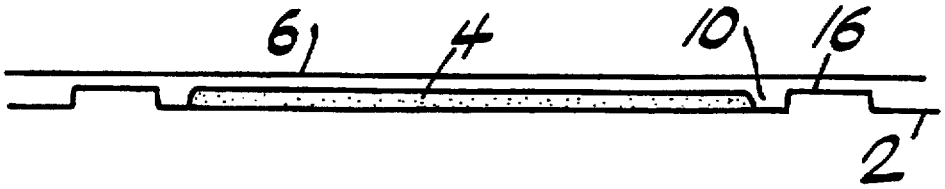
FIG. 6 shows a side view of the product sampler of FIG. 5.
Figure 7:
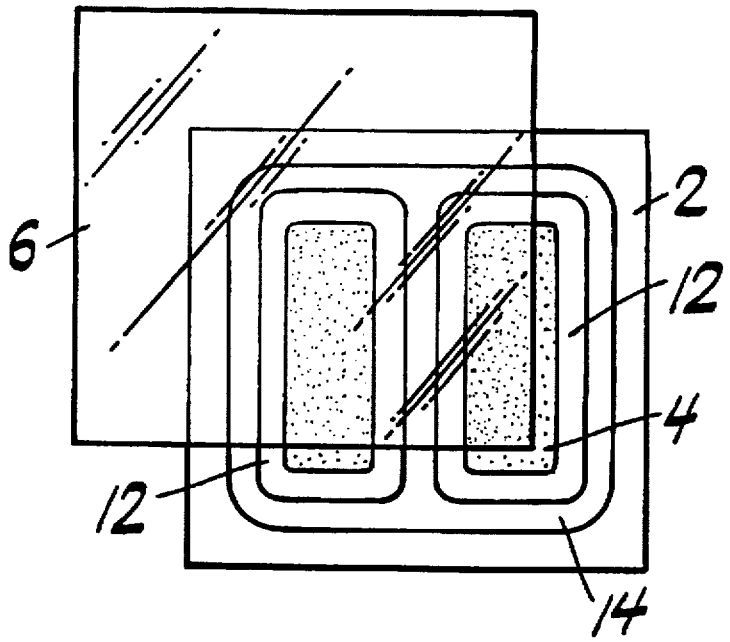
FIG. 7 shows a top view of the product sampler of the present invention provided in a multi-well embodiment.
Figure 8:
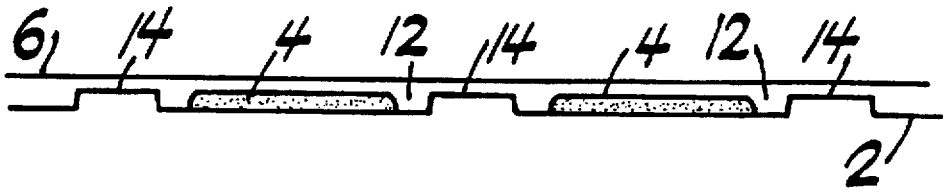
FIG. 8 shows a side view of the product sampler of FIG. 7.

In the embodiments of FIGS. 5–8, the embossed or debossed well 10 or multiple wells 12 can be formed in either the barrier laminate base described above, or in a base formed of a thermoformable plastic. To form the embossed or debossed well 10 (or multiple wells 12), the base is pressed between male and female dies. If the base is made of thermoformable plastic, the dies are pre-heated to about 210°–220° F. to soften the plastic during embossing/debossing at a dwell time of 0.5–1.5 seconds. The formation of the embossed/debossed well is done online, the product sample being screen printed into the well 10 in a subsequent step. Well 10 may be formed in any desired shape, such as the rectangular shape as shown in FIG. 5. In the multiple embodiment of the invention shown in FIG. 7–8, the embossing or debossing provides partitions 14 between the wells which allow multiple samples of liquid or semi-liquid products to be presented in a single package without mixing. The raised partitions 14 provides a surface against which the cover 6 can be adhered or heat sealed.

The screen printing of a product sample on a flat base is performed in accordance with conventional techniques such as disclosed in U.S. Pat. No. 4,751,934. However, in the embodiments of the present invention in which the product sample is screen printed into a well, a very coarse screen mesh such as 38 mesh to 60 mesh is employed, where "mesh" indicates the number of lines per inch of screen area. Lower mesh sizes, such as 17 mesh, are difficult to stretch since the threads are very thick, which leads to production inefficiency, very time consuming screen preparation, and poor visual print translation.

A coarse screen, as described above, combined with a soft squeegee, such as a 60 or 70 durometer, permits a considerable deposit of material being literally forced into the embossed/debossed area outlined by the well.

In the embodiments of the invention in which the base is provided with one or more wells, cover 6 can be secured to the upper edges 16 of the well or wells by heat sealing, as discussed above, or by a perimeter adhesive, depending upon the contents of the substance being sampled and the degree of hermetic sealing required to prevent loss of solvent, water or other ingredients. Likewise, as mentioned above, depending upon the substance being sampled either the base 2 or the cover 6, or both, may be formed of a barrier laminate constructed of multiple layers of polymers and/or foil and/or paper. If cover 6 is formed of a barrier laminate, the outer surface may be pre-printed with a fanciful or descriptive design or other printed matter and/or text identifying the screen printed product contained in the sampler.

The present invention, whether provided on a flat base or a base provided with wells, and whether formed of a barrier laminate or a thermoformable plastic, is particularly suitable and advantageous for sampling products based on a volatile silicone (examples of which are lipstick, liquid make-up and blush), or other substances, e.g. creams, lotions, fragrances, eye shadows, toiletries, where moisture loss, dry-out or solvent loss is a concern.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A product sampler, comprising:

a base formed of a barrier laminate, said base having an upper surface;

a unit dose of product screen printed onto said base; and a cover formed of a barrier laminate, said cover hermetically sealed to the upper surface of said base over said unit dose of product to prevent loss of components from said product.

2. A product sampler as recited in claim 1, further comprising a well formed in the upper surface of said base, said unit dose of screen printed product being contained in said well.

3. A product sampler as recited in claim 2, wherein said well comprises a debossed well.

4. A product sampler as recited in claim 2, wherein said well comprises an embossed well.

5. A product sampler as recited in claim 2, further comprising a plurality of said wells provided in a side-by-side configuration, each of said wells containing a unit dose sample of said screen printed product.

6. A product sampler as recited in claim 1, wherein said base comprises paper, and said barrier laminate cover is laminated to said base.

7. A product sampler as recited in claim 1, wherein said barrier laminate comprises a combination of barrier films including a foil laminate.

8. A product sampler as recited in claim 1, wherein said product sample comprises a volatile silicone base substance.

9. A product sampler as recited in claim 1, wherein said product sample comprises a volatile silicone base cosmetic.

10. A product sampler as recited in claim 1, wherein said barrier laminate cover is opaque and includes a printed outer surface.

11. A product sampler as recited in claim 10, wherein said barrier laminate cover comprises a combination of barrier films including a foil laminate.

12. A product sampler as recited in claim 1, wherein said cover is heat sealed to the upper surface of said base.

13. A product sampler as recited in claim 1, further comprising a perimeter adhesive applied to the upper surface of said base, and wherein said cover is sealed to the upper surface of said base by said perimeter adhesive.

14. A product sampler as recited in claim 1, wherein said barrier laminate base includes a board layer.

15. A product sampler as recited in claim 1, wherein said barrier laminate base includes a plastic layer.

16. A product sampler, comprising:

a base comprising a thermoformable plastic, said base having an upper surface;

a well formed in the upper surface of said base;

a unit dose of product screen printed in and contained in said well; and a cover hermetically sealed to said base to prevent loss of components from said product.

17. A product sampler as recited in claim 16, wherein said well comprises a debossed well.

18. A product sampler as recited in claim 16, wherein said well comprises an embossed well.

19. A product sampler as recited in claim 16, wherein said cover comprises a barrier laminate, and said cover is hermetically sealed to the upper surface of said base.

20. A product sampler as recited in claim 19, wherein said barrier laminate cover is opaque and includes a printed outer surface.

21. A product sampler as recited in claim 19, wherein said barrier laminate cover comprises a combination of barrier films including a foil laminate.

22. A product sampler as recited in claim 16, further comprising a perimeter adhesive applied to said base, and wherein said cover comprises a clear plastic film sealed to the upper surface of said base by said perimeter adhesive.

23. A product sampler as recited in claim 16, wherein said cover comprises a clear plastic film heat sealed to the upper surface of said base.

24. A product sampler as recited in claim 16, wherein said product sample comprises a volatile silicone base substance.

25. A product sampler as recited in claim 16, wherein said product sample comprises a volatile silicone base cosmetic.

26. A product sampler as recited in claim 16, further comprising a plurality of said wells provided in a side-by-side configuration, each of said wells containing a unit dose sample of said screen printed product.

27. A product sampler, comprising:

a base formed of a barrier laminate, said base having an upper surface;

a unit dose of product screen printed onto said upper surface of said base; and a cover hermetically sealed to said base to prevent loss of components from said product, said cover comprising a clear plastic barrier laminate and having an outer surface, and wherein at least a portion of the outer surface is provided with printed matter.

28. A product sampler as recited in claim 27, further comprising a well formed in the upper surface of said base, said unit dose of screen printed product being contained in said well.

29. A product sampler as recited in claim 28, wherein said well comprises a debossed well.

30. A product sampler as recited in claim 28, wherein said well comprises an embossed well.

31. A product sampler as recited in claim 28, further comprising a plurality of said wells provided in a side-by-side configuration, each of said wells containing a unit dose sample of said screen printed product.

32. A product sampler as recited in claim 27, wherein said barrier laminate base includes a paper layer.

33. A product sampler as recited in claim 27, wherein said barrier laminate base includes a board layer.

34. A product sampler as recited in claim 27, wherein said barrier laminate base includes a plastic layer.

35. A product sampler as recited in claim 27, wherein said product sample comprises a volatile silicone base substance.

36. A product sampler as recited in claim 27, wherein said product sample comprises a volatile silicone base cosmetic.

* * * * *